US007155142B2

(12) United States Patent
Shifley et al.

(10) Patent No.: US 7,155,142 B2
(45) Date of Patent: Dec. 26, 2006

(54) TENSION CONTROL FOR A BELT FUSER/FINISHER

(75) Inventors: James D. Shifley, Spencerport, NY (US); Mark A. Wilde, Brockport, NY (US)

(73) Assignee: Eastman Kodak Company, Rochester, NY (US)

( * ) Notice: Subject to any disclaimer, the term of this patent is extended or adjusted under 35 U.S.C. 154(b) by 218 days.

(21) Appl. No.: 10/818,870

(22) Filed: Apr. 6, 2004

(65) Prior Publication Data

US 2005/0220487 A1 Oct. 6, 2005

(51) Int. Cl.
*G03G 15/20* (2006.01)

(52) U.S. Cl. ..... 399/122; 399/329; 399/341

(58) Field of Classification Search ..... 399/122, 399/165, 329, 341
See application file for complete search history.

(56) References Cited

U.S. PATENT DOCUMENTS 4,634,264 A 1/1987 Takahashi
5,257,071 A 10/1993 Hediger
5,321,480 A * 6/1994 Merle et al. ..... 399/329
5,923,937 A 7/1999 Thompson et al. ..... 399/302
6,026,274 A 2/2000 Aslam et al. ..... 399/329

FOREIGN PATENT DOCUMENTS

EP 0 384 467 A2 8/1990

* cited by examiner

*Primary Examiner*—William J. Royer
(74) *Attorney, Agent, or Firm*—Lawrence P. Kessler

(57) ABSTRACT

A belt fuser/finisher including an endless fusing/finishing belt directed around a closed loop path defined by a heated roller and at least one unheated roller. The endless fusing/finishing belt and rollers are mounted on a belt frame that is pivotally attached to a mainframe. The belt frame may be rotated from a latched running position to service position, and the tension in the endless fusing/finishing belt can be relieved, thereby enabling the endless fusing/finishing belt to be easily removed and replaced.

16 Claims, 9 Drawing Sheets

TENSION CONTROL FOR A BELT FUSER/FINISHER

FIELD OF THE INVENTION

This invention is directed generally to a belt fuser/finisher apparatus, and more particularly to a belt fuser/finisher apparatus in which the fusing/finishing belt is easily changed when necessary due to wear or damage, or for any other desired reason.

BACKGROUND OF THE INVENTION

In electrostatographic reproduction apparatus a latent image charge pattern is formed on a uniformly charged charge-retentive or photoconductive member having dielectric characteristics. Pigmented marking particles, henceforth referred to as toner particles, are attracted to the latent image charge pattern to develop such image on the photoconductive member. A receiver member, such as a sheet of paper, transparency or other medium, is then brought into contact with the photoconductive member, and an electric field applied to transfer the toner particle developed image to the receiver member from the photoconductive member. After transfer, the receiver member bearing the transferred image is transported away from the photoconductive member, and the image is fixed (fused) to the receiver member by heat and pressure to form a permanent reproduction thereon.

This process can be used to create photographic quality multicolor toner images when the toner particles are small, (i.e., less than about 10 micrometers), and the receivers, typically papers, are smooth. A typical method of making a multicolor toner image involves trichromatic color synthesis by subtractive color formation. In such synthesis, multiple latent electrostatic images are formed, each representing a different color, and each image is developed with a toner of a different color. Typically, the colors will correspond to each of the three subtractive primary colors (cyan, magenta and yellow) and black, if desired. After developing each color separation on a photoconductive element, it is transferred to a receiver in registration with the other color toner images. After all the color toners have been transferred to the receiver, the toners are fixed or fused to the receiver in a fusing station. It has been found that fusing of multi-color toner particle images to a receiver member requires substantially different operating parameters than fusing standard black toner particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

The fusing station of a typical multicolor electrostatographic reproduction apparatus includes a fuser member, which can be a roller, belt, or any surface having a suitable shape for fixing thermoplastic toner particles to the receiver member. The fusing step using a roller fuser member commonly includes passing the receiver member, with the toner particle image thereon, between a pair of engaged rollers that produce an area of pressure contact known as a fusing nip. In order to form the fusing nip, at least one of the rollers typically includes a compliant or conformable layer. Heat is transferred from at least one of the rollers to the toner particles in the fusing nip, causing the toner particles to partially melt and attach to the receiver member. In the case where the fuser member is a deformable heated roller, a resilient elastomeric layer is typically bonded to the core of the roller, with the roller having a smooth outer surface. Where the fuser member is in the form of a belt, e.g., a flexible endless belt that passes around the heated roller, it typically has a smooth outer surface, which may also be hardened. The toner particle developed image on the receiver member is brought into contact with the belt in the nip between the heated roller and pressure roller, causing the toner particles to partially melt and attach to the receiver member and belt. The receiver member is transported away from the heated nip on the belt and cooled to solidify the toner particle image. The receiver member is then stripped from the belt with the toner particle image having a surface finish from the belt against which it solidified.

A belt fuser may function as the integral fusing station in a reproduction apparatus or as a post printing finishing device to alter the surface finish of the toner particle image after it exits the reproduction apparatus. As a post printing finishing device, the belt fuser may be in-line with the reproduction apparatus, meaning the image bearing receiver members are transported directly from the reproduction apparatus into the finishing device, or the belt fuser may be a stand-alone unit, meaning the image bearing receiver members are manually stacked in the finishing device which has a feeder that feeds the receiver members through the belt fusing/finishing section. The function of a post printing finishing device may be to increase or decrease the gloss of the toner particle image or to impart a textured finish to the toner particle image. Different belts may be used for these different functions. Whether the belt fuser is integral to the reproduction apparatus or used as a post printing finishing device, the belt may periodically require changing, either due to damage or general wear, or because a different belt with a different surface finish is required. It is therefore desirable that the belt be capable of being replaced easily and quickly.

SUMMARY OF THE INVENTION

In view of the above, this invention is directed to a belt fuser/finisher having a fusing/finishing belt that is capable of being changed or replaced easily and quickly. The belt fuser/finisher of this invention includes an endless belt directed about a closed loop path defined by a heated roller and a plurality of unheated rollers. The endless belt and rollers are mounted on a belt frame that is pivotably attached to a mainframe. The belt frame may be rotated from a latched running position to an unlatched service position. A mechanism is provided on the belt frame for changing the tension of the endless belt from a running tension to a service tension. With the belt frame in the running position and the belt in running tension, a pressure roller is in nip-forming contact with the heated roller. When it becomes necessary to change the belt, the pressure roller is located out of contact with the heated roller, the belt tension is decreased to service tension, and the belt frame is unlatched and rotated approximately 90° to the service position. In this service position with the belt tension decreased, the belt may be easily removed and replaced.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
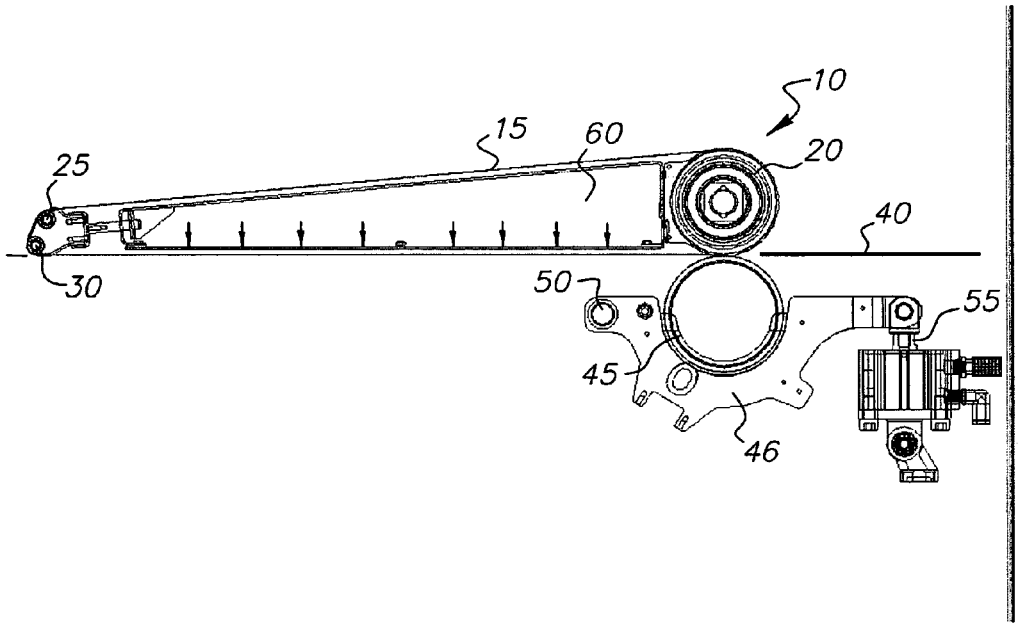
FIG. 1 is a schematic side elevation view showing the relationship of the endless belt, the heated roller, and the pressure roller of the invention in the running position.

Referring now to the accompanying drawings, a schematic elevation view of the belt fuser/finisher of this invention, designated generally by the numeral 10, is shown in FIG. 1. The purpose of FIG. 1 is to show the belt path around a heated roller 20 and unheated rollers 25 and 30 in relation to a pressure roller 45 without details of a belt frame 61 or mainframe 47. Endless belt 15 is directed around heated roller 20 and unheated rollers 25 and 30. Hereafter, unheated roller 30 will be referred to as detack roller 30 for reasons that will become apparent below. Pressure roller 45 is mounted in pressure roller frame 46, which is pivotably mounted in the mainframe (not shown in FIG. 1) so as to be rotatable about pivot axis 50. Piston 55 is coupled to pressure roller frame 46 so that on activation it rotates pressure roller frame 46 upward to bring pressure roller 45 into nip-forming contact with endless belt 15 substantially opposite heated roller 20. Heated roller 20 is rotatably driven in the direction of the arrow by any suitable motor (not shown in FIG. 1).

A receiver member 40 bearing a toner particle developed image is fed into the nip between pressure roller 45 and endless belt 15 entrained about heated roller 20, so that the toner particle developed image contacts the heated endless belt 15. The toner particles become partially melted and thereby attached to endless belt 15 and receiver member 40 as receiver member 40 passes through the nip between heated roller 20 and pressure roller 45. The receiver member 40 is transported by endless belt 15 past a cooling plenum 60. Pressurized air, indicated by the vertical arrows in FIG. 1, is directed through holes in the plenum 60 onto endless belt 15, thereby cooling and solidifying the toner particle image. By the time the leading edge of the receiver member 40 reaches detack roller 30, the toner particles have solidified. Aided by the small diameter of detack roller 30, equal to or less than 1.5 inches, and the inherent beam strength of the receiver member 40, the receiver member 40 with the toner particle image is detacked from endless belt 15. The solidified toner particle image has a particular surface finish as a result of having been cast against endless belt 15.

Figure 2:
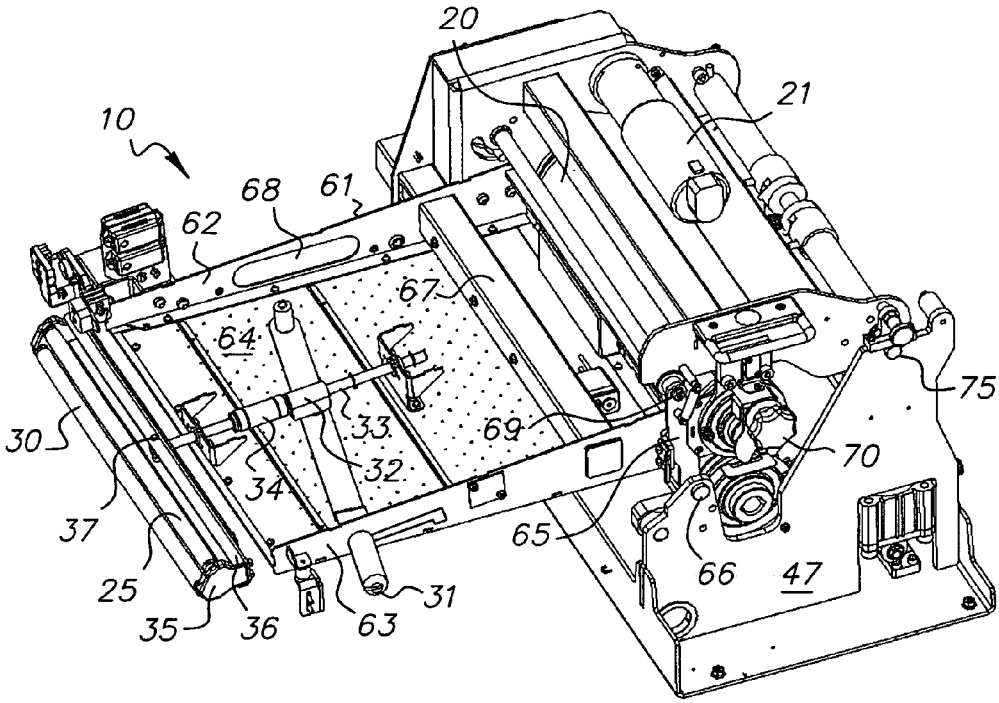
FIG. 2 is a view in perspective of the belt frame, in the running position with the belt removed, and including the belt tensioning mechanism in the running tension position.
Figure 3:
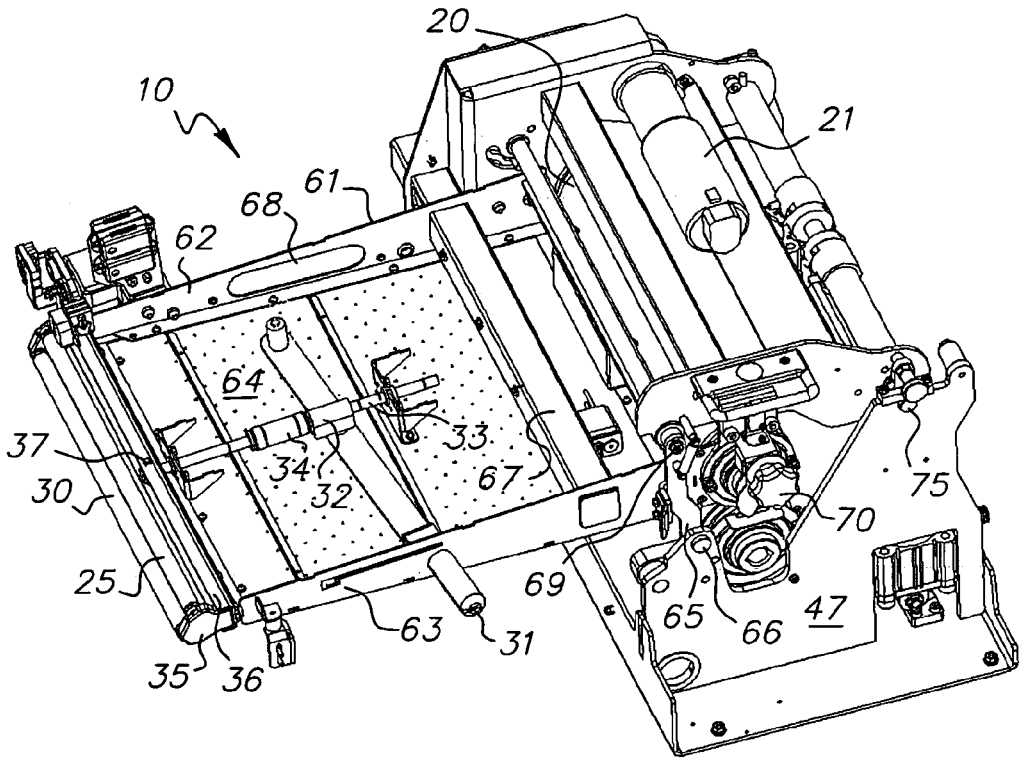
FIG. 3 is a view in perspective of the belt frame, in the running position with the belt removed, and including the belt tensioning mechanism in the service tension position.

Referring now to FIG. 2, there is shown, in detail, belt frame 61, on which is mounted heated roller 20, unheated roller 25 and detack roller 30. The belt frame 61 includes a side plates 62 and 63, base plate 64, and stiffening cross member 67. A top plate (removed from the drawing to facilitate viewing) connects with the side plates 62 and 63, base plate 64, and stiffening cross member 67 to define the cooling plenum 60. Belt frame 61 is pivotally mounted to mainframe 47 for rotation about axis 75. In FIG. 2, endless belt 15 is not shown in order to show more clearly the detail of belt frame 61 including the mechanism for tensioning the endless belt 15. The tensioning mechanism for endless belt 15 includes a tension lever 31 pivotally connected to a collar 32 that slides on shaft 33. Unheated roller 25 and detack roller 30 are attached to shaft 33 via a yoke having end plates 35 and cross members 36. Cross members 36 are pivotally attached to shaft 33 to rotate about axis 37 substantially perpendicular to the axis of the shaft 33. Thus, the yoke supporting unheated roller 25 and detack roller 30 can castor about the axis of shaft 33. In FIG. 2, tension lever 31 is shown in the running tension position in which compression on the belt tensioning spring 34 will be compressed when endless belt 15 is in place to apply operative (running) tension to the endless belt 15 through the supporting yoke and rollers 25 and 30. In FIG. 3, tension lever 31 is shown in the service tension position in which compression on the belt tensioning spring 34 will be relieved when endless belt 15 is in place. This relieves the tension on the endless belt 15 to a reduced service tension.

Also shown in FIGS. 2 and 3 is motor 21 which drives heated roller 20 via a suitable gear train not visible in FIGS. 2 and 3. Further, in FIGS. 2 and 3, one can see a slot 68 in side plate 62. With endless belt 15 installed, and in running tension, pressurized cooling air from any suitable source is injected into plenum 60 through slot 68. The pressurized cooling air flows through a plurality of holes in base plate 64 of the plenum, thereby cooling endless belt 15.

Figure 4A:
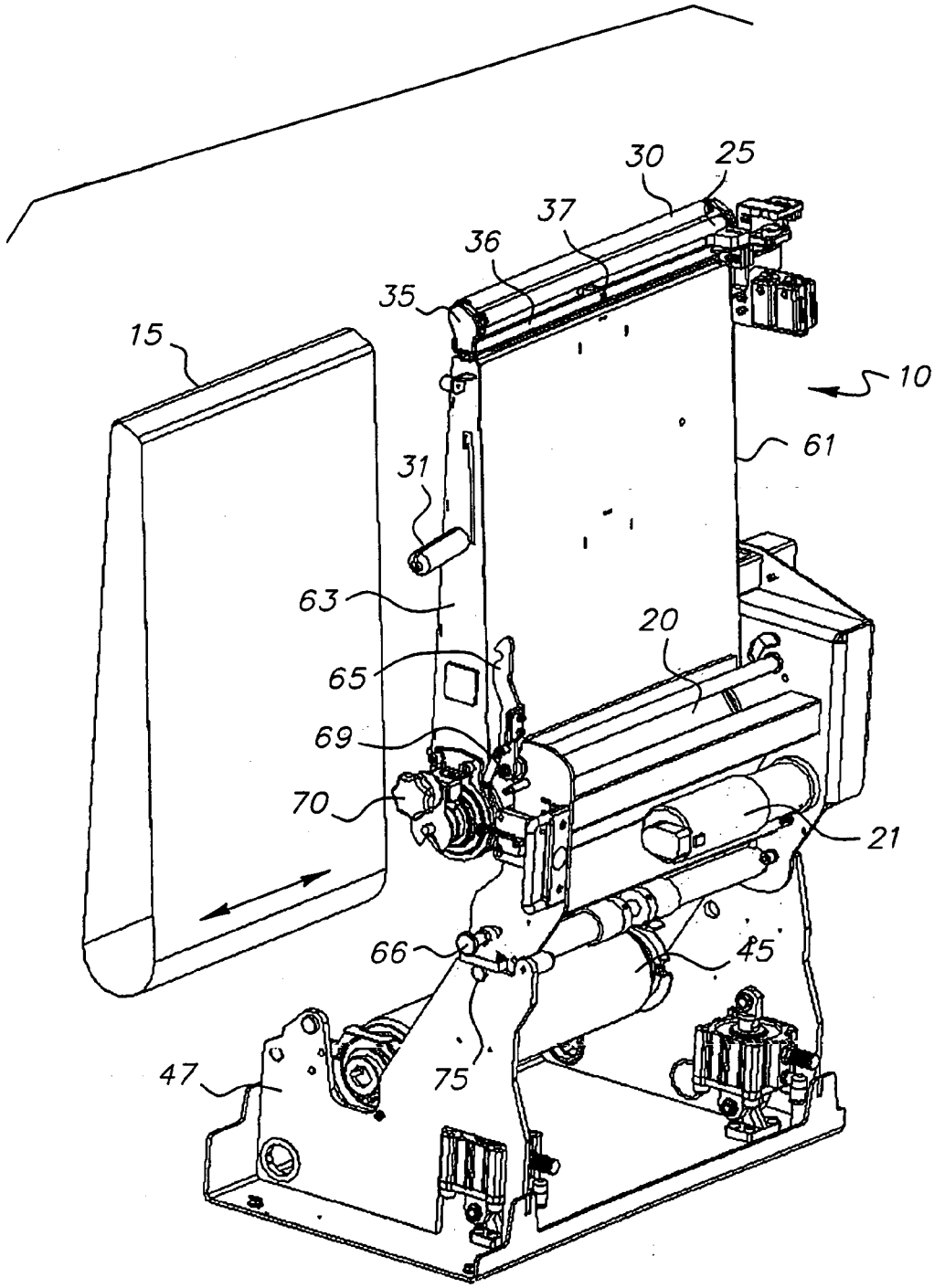
FIG. 4*a* is a view in perspective of the belt frame in the service position with the belt removed.
Figure 4B:
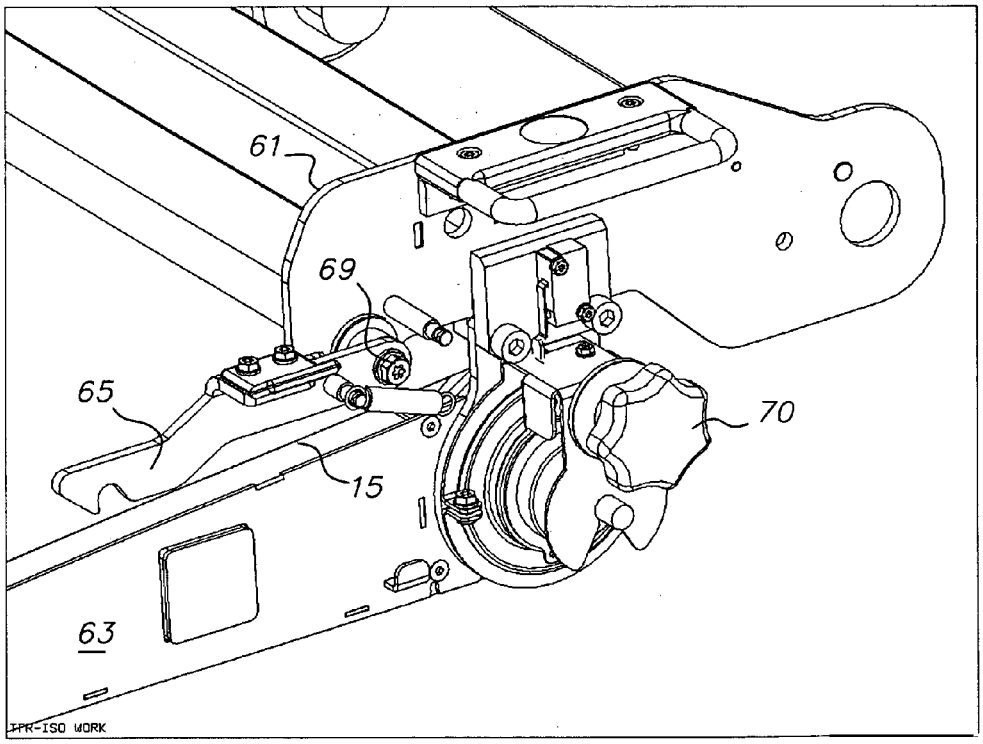
FIG. 4*b* is an expanded partial view of the apparatus in FIG. 4*a*, showing the heated roller bearing retainer in its latched running position.
Figure 4C:
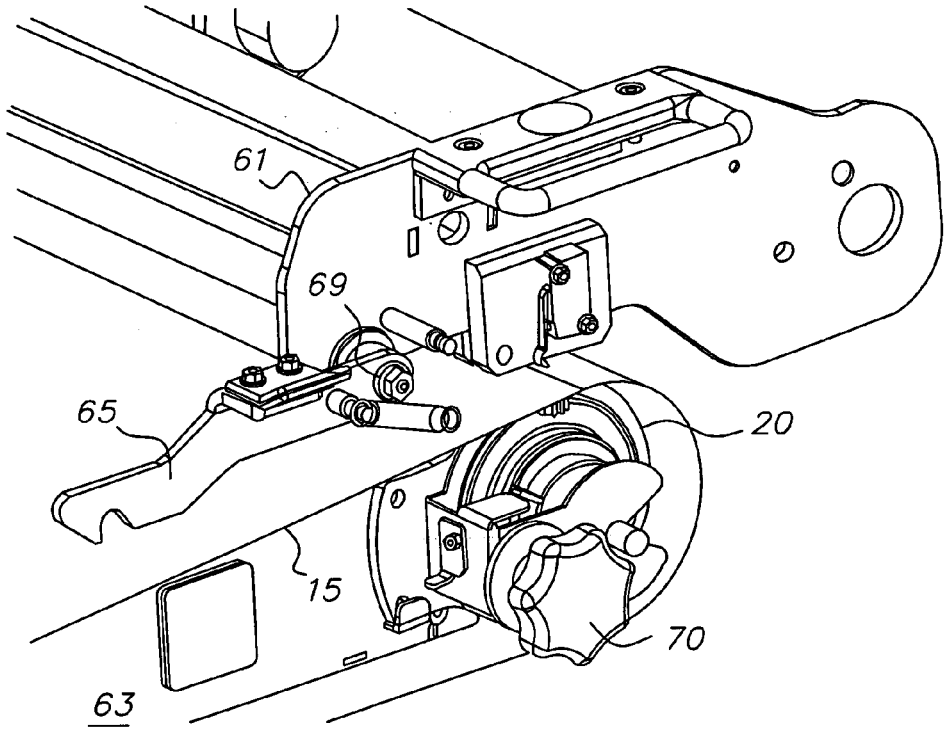
FIG. 4*c* is an expanded partial view of the apparatus in FIG. 4*a*, showing the heated roller bearing retainer rotated out of the way to clear the belt as it is slid off the rollers.

Belt frame 61 is held in the running position by latch 65 cooperating with a pin 66. When it becomes necessary to replace endless belt 15, either because it has become worn or damaged, or in order to change to a belt with a different surface finish, pressure roller 45 is rotated out of contact with heated roller 20. This is accomplished by deactivating piston 55 (FIG. 1) to move frame 46 downward to disengage the nip-forming contact between the pressure roller 45 and the endless belt 15. Latch 65 is disengaged from pin 66 by being rotated clockwise approximately 90° about pin 69. This releases belt frame 61 so that it may in turn be rotated 90° (clockwise in the drawings) about axis 75 to a service position. FIG. 4*a* shows belt frame 61 rotated to the service position. The tension lever 31 is then moved to the service tension position to relieve tension on the endless belt 15. Before removing endless belt 15, the heated roller bearing retainer 70 is rotated out of the way so that endless belt 15 may be slid off of heated roller 20. Heated roller bearing retainer 70 secures heated roller 20 to belt frame 61 to prevent heated roller 20 from deflecting when pressure roller 45 is engaged against heated roller 20. Before removing endless belt 15, heated roller bearing retainer 70 must be unlatched and rotated 90° counterclockwise (in the drawings), leaving heated roller 20 cantilevered from the opposite end thereof supported in a bearing (not shown) at the rear of the belt frame 61. FIG. 4*b* is an expanded partial view of FIG. 4*a* showing heated roller bearing retainer 70 in its latched position, and FIG. 4*c* is the same expanded partial view showing heated roller bearing retainer 70 in its unlatched rotated position. After having heated roller bearing retainer 70 to the unlatched rotated position of FIG. 4*c*, endless belt 15 may be easily removed and/or installed by sliding the endless belt 15 over heated roller 20, unheated roller 25, and detack roller 30. FIG. 4*a* shows endless belt 15 removed after heated roller bearing retainer 70 has been unlatched and rotated 90° counterclockwise. In FIG. 4*c* endless belt 15 is shown partially slid off of heated roller 20. Also shown in FIGS. 4*b* and 4*c* is latch 65 in the unlatched rotated position.

As noted above, the belt fuser/finisher 10 of this invention may function as the integral fusing station in a reproduction apparatus or as the print surface finishing section of a post printing finishing device to alter the surface finish of the toner particle image after it exits the reproduction apparatus. A post printing finishing device may be in-line with the reproduction apparatus, meaning the image bearing receiver members are transported directly from the reproduction apparatus into the post printing finishing device, or the post printing finishing device may stand-alone, meaning the image bearing receiver members are manually stacked in the post printing finishing device which has a feeder which feeds the receiver members through the print surface finishing section. The function of a post printing finishing device may be to increase or decrease the gloss of the toner particle image or to impart a textured finish to the toner particle image.

Figure 5:
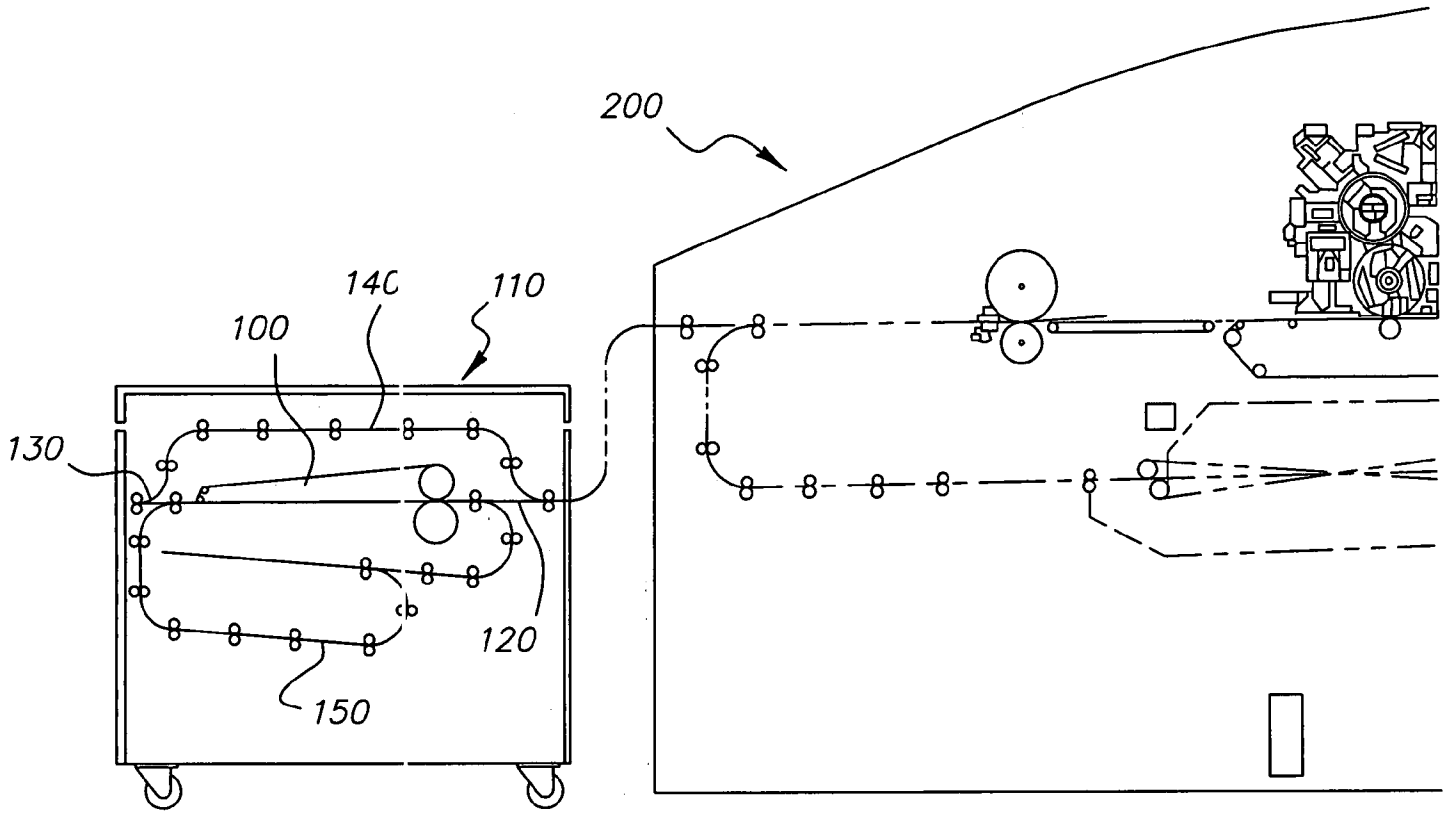
FIG. 5 is a schematic side elevation view of the belt fuser/finisher apparatus of this invention incorporated in an inline, post printing finishing device.

FIG. 5 shows an elevation view of an in-line post printing finishing device, generally designated as numeral 110, incorporating the belt fuser/finisher of this invention, and interfaced to a reproduction apparatus generally designated by numeral 200. In this embodiment output prints from reproduction apparatus 200 are fed directly into post printing finishing device 110. The belt fuser/finisher of this invention functions as the print surface finishing section of post printing finishing device 110 and is shown schematically in FIG. 5 and designated generally as numeral 100. Post printing finishing device 110 includes an input print transport section 120, a finished print transport section 130, a pass-through print transport section 140, and a duplex print return transport section 150. If no further finishing of output prints from reproduction apparatus 200 is required, the output prints are diverted around the print surface finishing section 100 by pass-through print transport section 140. If the output prints from reproduction apparatus 200 have toner particle images to be finished on both sides, the output prints from reproduction apparatus 200 are first fed through print surface finishing section 100 for finishing of the toner particle image on the first side, and then returned for finishing of the toner particle image on the second side in duplex print return transport section 150. Finished prints exit post printing finishing device 110 via finished print transport section 130.

Figure 6A:
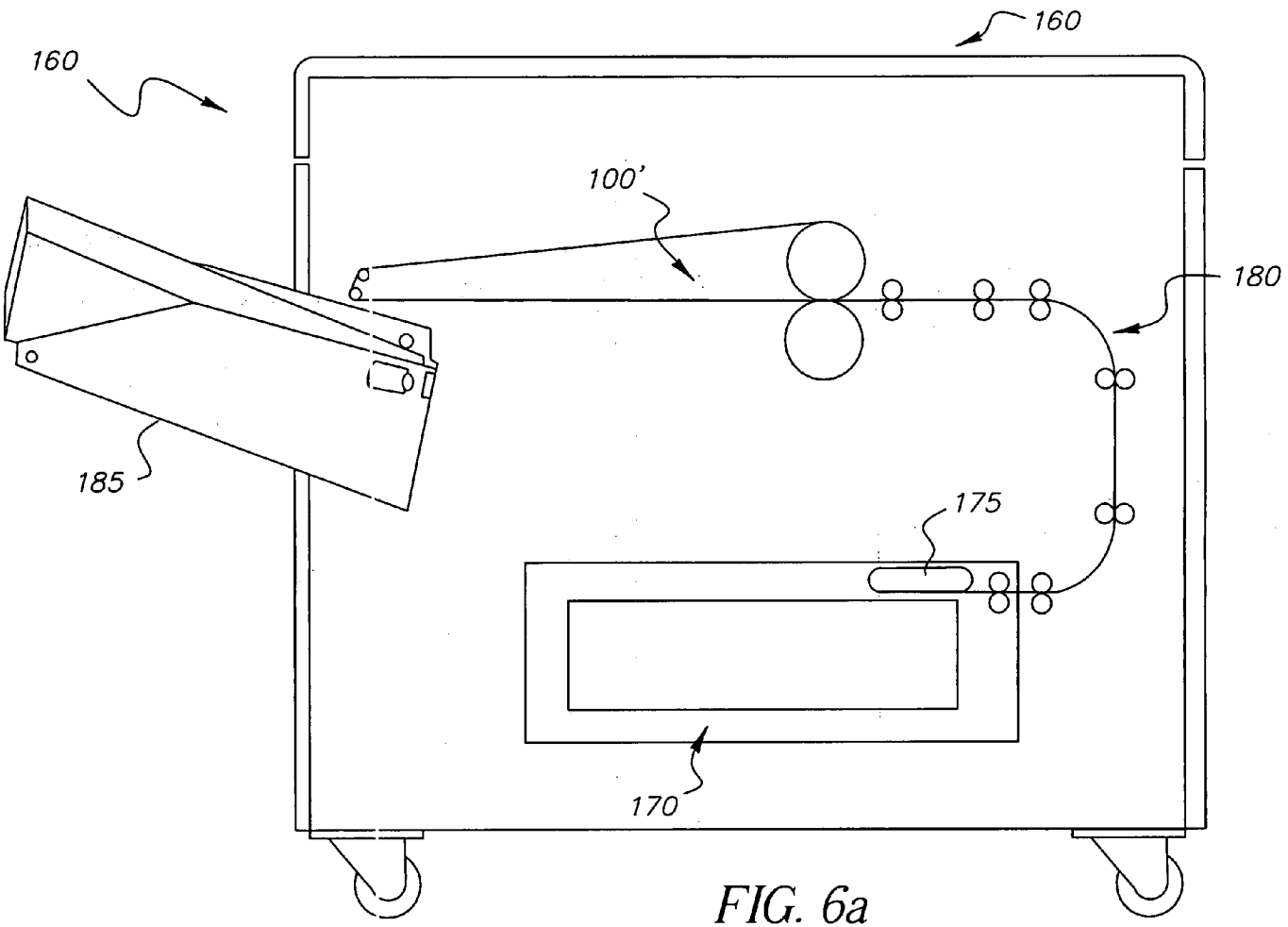
FIG. 6*a* is a schematic side elevation view of the belt fuser/finisher apparatus of this invention incorporated in a stand-alone post printing finishing device.
Figure 6B:
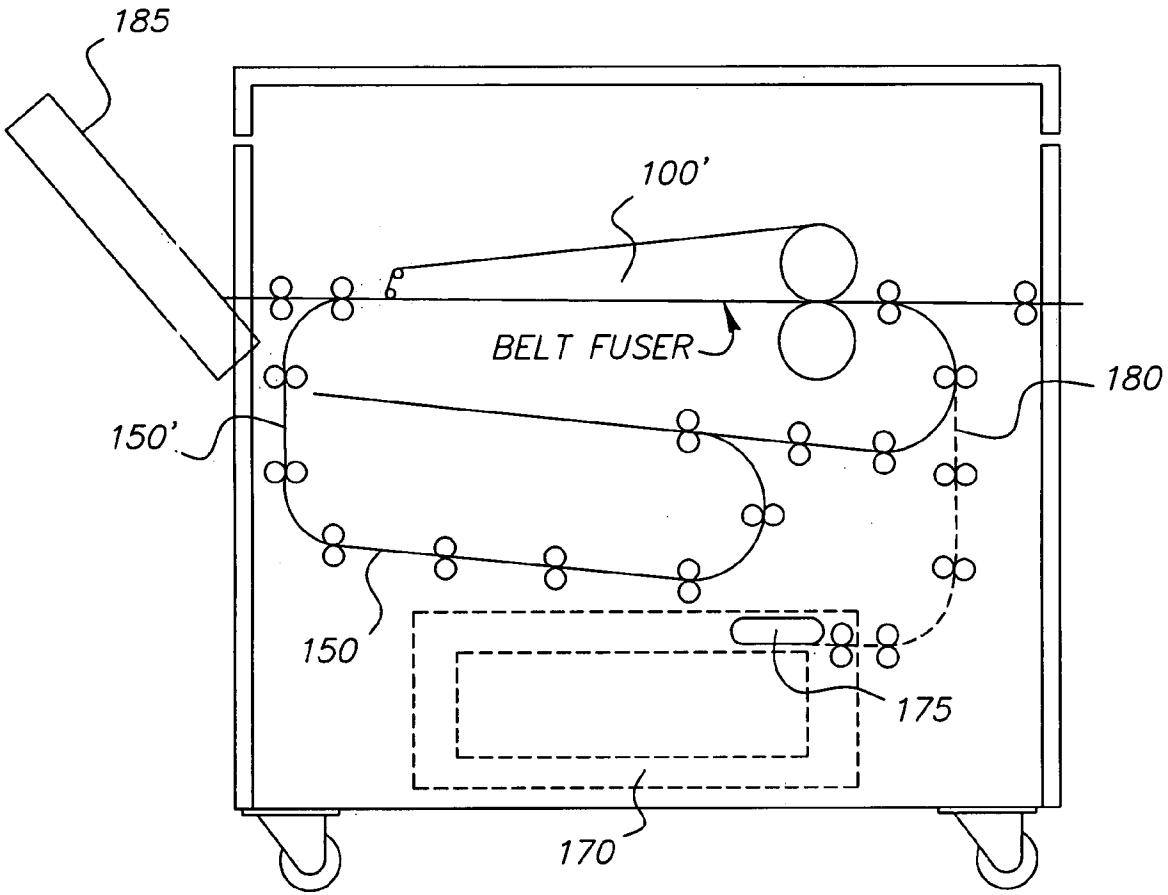
FIG. 6*b* is a schematic side elevation view of the stand-alone post printing finishing device of FIG. 6*a* with a duplex return path added.

FIG. 6*a* shows an elevation view of a stand-alone post printing finishing device, generally designated as numeral 160, incorporating the belt fuser/finisher of this invention as the print surface finishing section, generally designated by numeral 100'. In this embodiment output prints to be finished are manually placed in an input bin 170. The prints to be finished are fed from input bin 170 by feeder 175 and transported to print surface finishing section 100' by print transport section 180. The finished prints are stacked in output bin 185. If the prints to be finished have toner particle images to be finished on both sides, finishing of the toner particle images on the second side would be accomplished by manually turning over and returning the prints to input bin 170, and then feeding through print surface finishing section 100' a second time. This manual finishing of second side toner particle images may be automated by including, in stand-alone post printing finishing device 160, a duplex print return transport section, 150' as is shown in FIG. 6*b*.

The invention has been described in detail with particular reference to certain preferred embodiments thereof, but it will be understood that variations and modifications can be effected within the spirit and scope of the invention.

What is claimed is:

1. A belt fuser/finisher for an electrostatographic reproduction apparatus, said belt fuser/finisher comprising:

a mainframe;

a belt frame pivotally mounted to said mainframe, said belt frame having a running position and a service position, said service position being angularly displaced from said running position;

a closed loop path defined by a heated roller and at least one unheated roller rotatably mounted on said belt frame, said closed loop path being adapted to support an endless fusing/finishing belt;

means for rotatably driving said heated roller to move said endless fusing/finishing belt about said closed loop path;

means for directing cooling air onto a section of said endless fusing/finishing belt downstream of said heated roller in the direction of movement of said endless fusing/finishing belt; and means for changing the tension in said endless fusing/finishing belt between a running tension and a service tension wherein said endless fusing/finishing belt can be readily replaced on said closed loop path.

2. The belt fuser/finisher of claim 1, further comprising a retainer member connected to one end of said heated roller, said retainer member being movable to a retaining position when said belt frame is in said running position and a position leaving said heated roller, cantilevered from said belt frame when said belt frame is in said service position.

3. The belt fuser/finisher of claim 2, wherein at least one of said unheated rollers has a diameter equal to or less than 1.5 inches.

4. The belt fuser/finisher of claim 2, wherein at least one of said unheated rollers has a diameter equal to or less than 0.75 inches.

5. The belt fuser/finisher of claim 1, further including a pressure roller movably mounted on said mainframe; and means for moving said pressure roller into nip-forming association with said heated roller and to a position remote from said nip-forming association with said heated roller.

6. A finishing apparatus for altering the surface finish of prints from an electrostatographic reproduction apparatus, said finishing apparatus comprising:

a print surface finishing section including a mainframe, a belt frame pivotally mounted to said mainframe, said belt frame having a running position and a service position, said service position being angularly displaced from said running position, a closed loop path defined by a heated roller and at least one unheated roller rotatably mounted on said belt frame with at least one of said unheated rollers having a diameter of less than 1.5 inches, said closed loop path being adapted to support an endless fusing/finishing belt, means for rotatably driving said heated roller to move said endless fusing/finishing belt about said closed loop path, means for directing cooling air onto a section of said endless fusing/finishing belt downstream of said heated roller, means for changing the tension in said endless fusing/ finishing belt between a running tension and a service tension wherein said endless fusing/finishing belt can be readily replaced on said closed loop path, and a retainer member rotatably connected to one end of said heated roller, said retainer member having features defining a heated roller retaining position corresponding to said running position of said belt frame and a heated roller cantilever position corresponding to said service position of said belt frame;

an input print transport section interfaced to said electrostatographic reproduction apparatus for transporting said prints from said electrostatographic reproduction apparatus to said print surface finishing section; and a finished print transport section for transporting said prints to an output bin.

7. The finishing apparatus of claim 6, further including a pressure roller movably mounted on said mainframe; and means for moving said pressure roller into nip-forming association with said heated roller and to a position remote from said nip-forming association with said heated roller.

8. The finishing apparatus of claim 6, wherein at least one of said unheated rollers has a diameter equal to or less than 0.75 inches.

9. The finishing apparatus of claim 6, further comprising a pass-through print transport section for optionally diverting said prints around said print surface finishing section.

10. The finishing apparatus of claim 9, further comprising a duplex return print transport section for diverting said prints, exiting from said print surface finishing section, back through said print surface finishing section to finish the second side of said prints.

11. The finishing apparatus of claim 10, wherein at least one of said plurality of unheated rollers has a diameter equal to or less than 0.75 inches.

12. A finishing apparatus for altering the surface finish of prints from an electrostatographic reproduction apparatus, said finishing apparatus comprising:

a print surface finishing section including a mainframe, a belt frame pivotally mounted to said mainframe, said belt frame having a running position and a service position, said service position being angularly displaced from said running position, a closed loop path defined by a heated roller and at least one unheated roller rotatably mounted on said belt frame with at least one of said unheated rollers having a diameter of less than 1.5 inches, said closed loop path being adapted to support an endless fusing/finishing belt, means for rotatably driving said heated roller to move said endless fusing/finishing belt about said closed loop path, means for directing cooling air onto a section of said endless fusing/finishing belt downstream of said heated roller, means for changing the tension in said endless fusing/finishing belt between a running tension and a service tension wherein said endless fusing/finishing belt can be readily replaced on said closed loop path, and a retainer member rotatably connected to one end of said heated roller, said retainer member having features defining a heated roller retaining position corresponding to said running position of said belt frame and a heated roller cantilever position corresponding to said service position of said belt frame;

an input bin for said prints, said input bin having means for feeding said prints, from said input bin, onto an input print transport for transport to said print surface finishing section; and a finished print transport section for transporting said prints to an output bin.

13. The finishing apparatus of claim 12, further including a pressure roller movably mounted on said mainframe; and means for moving said pressure roller into nip-forming association with said heated roller and to a position remote from said nip-forming association with said heated roller.

14. The finishing apparatus of claim 13, wherein at least one of said unheated rollers has a diameter equal to or less than 0.75 inches.

15. The finishing apparatus of claim 13, further comprising a duplex return print transport section for diverting said prints, exiting from said print surface finishing section, back through said print surface finishing section to finish the second side of said prints.

16. The finishing apparatus of claim 15, wherein at least one of said unheated rollers has a diameter equal to or less than 0.75 inches.

* * * * *